US005144802A

United States Patent [19]

Ruzic

[11] Patent Number: 5,144,802

[45] Date of Patent: Sep. 8, 1992

[54] ROTARY FLUID APPARATUS HAVING PAIRS OF CONNECTED VANES

[76] Inventor: Ivan Ruzic, 5130 Portage Road, Apartment 216, Niagara Falls, Ontario, Canada, L2E 6Z4

[21] Appl. No.: 545,886

[22] Filed: Jun. 29, 1990

[51] Int. Cl.[5] ..... F16D 31/06; F01C 1/344; F04C 11/00

[52] U.S. Cl. ..... 60/484; 418/15; 418/97; 418/148; 418/255; 418/260

[58] Field of Search ..... 418/15, 97, 148, 255, 418/260, 264; 60/484

[56] References Cited

U.S. PATENT DOCUMENTS

| | | | |
|---|---|---|---|
| 858,778 | 7/1907 | Austin | 418/255 |
| 1,290,657 | 1/1919 | Rasmussen | 418/255 |
| 1,719,134 | 7/1929 | Roessler | 418/255 |
| 1,750,212 | 3/1930 | Caskey | 418/255 |
| 2,195,968 | 4/1940 | Meador | 418/255 |
| 2,585,406 | 2/1952 | Reynolds | 418/255 |
| 3,092,970 | 6/1963 | Sampietro | 60/484 |
| 3,139,722 | 7/1964 | Yokoi . | |
| 3,385,513 | 5/1968 | Kilgore | 418/15 |
| 3,507,261 | 4/1970 | Myers et al. . | |
| 3,589,344 | 6/1971 | Steinke . | |
| 3,688,749 | 9/1972 | Wankel . | |
| 3,817,220 | 6/1974 | Brumm et al. . | |
| 3,886,908 | 6/1975 | Ruzic . | |
| 3,900,942 | 8/1975 | Ainsworth | 418/255 |
| 3,988,080 | 10/1976 | Takada | 418/255 |
| 4,385,873 | 5/1983 | Richter | 418/255 |

FOREIGN PATENT DOCUMENTS

| | | | |
|---|---|---|---|
| 974886 | 9/1975 | Canada . | |
| 1011256 | 5/1977 | Canada . | |
| 531659 | 10/1921 | France | 418/255 |

*Primary Examiner*—John J. Vrablik

*Attorney, Agent, or Firm*—St. Onge Steward Johnston & Reens

[57] ABSTRACT

Apparatus for performing a plurality of functions including fluid pump, fluid motor, fluid transmission, air compressor and steam engine employ a circular rotor chamber with a rotor operable therein. The rotor is connected to a drive shaft, both of which are offset from the center of the chamber. The rotor employs at least one pair of opposed vanes which are slidable in relation to the center of the rotor and move with the rotor in contact with the circumferential chamber wall. Valves, vanes and related elements are arranged to effect the intended function.

16 Claims, 9 Drawing Sheets

FIG. 1
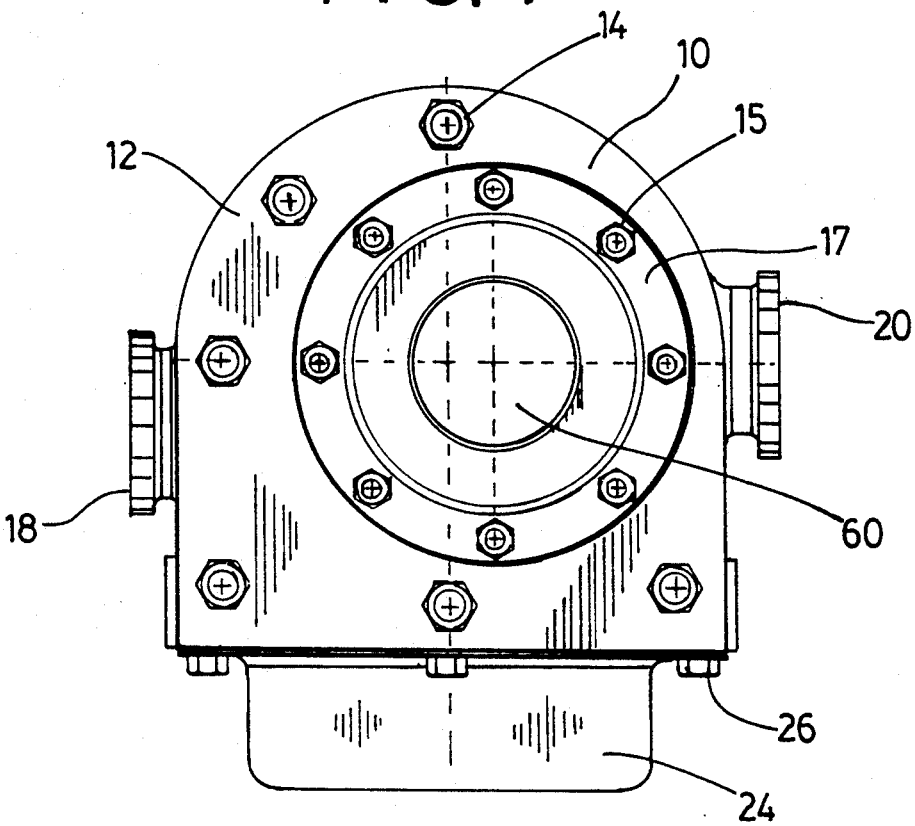
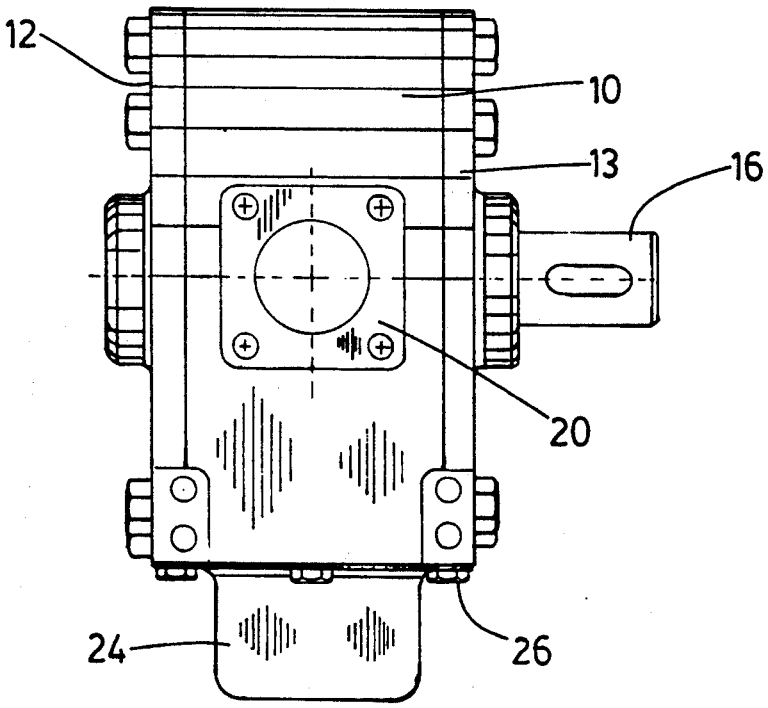
FIG. 2

FIG. 3
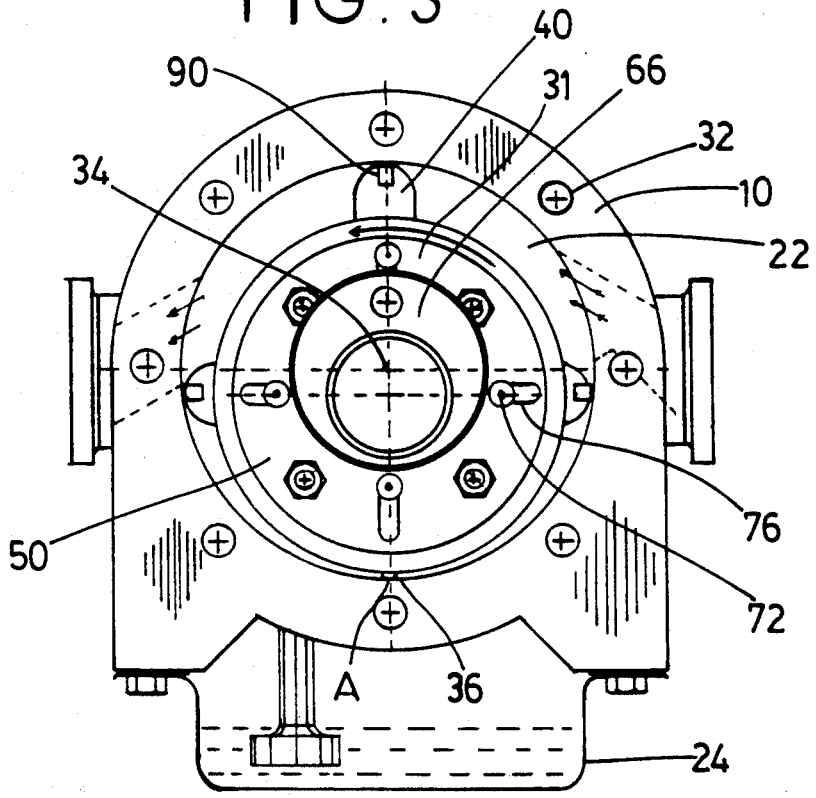
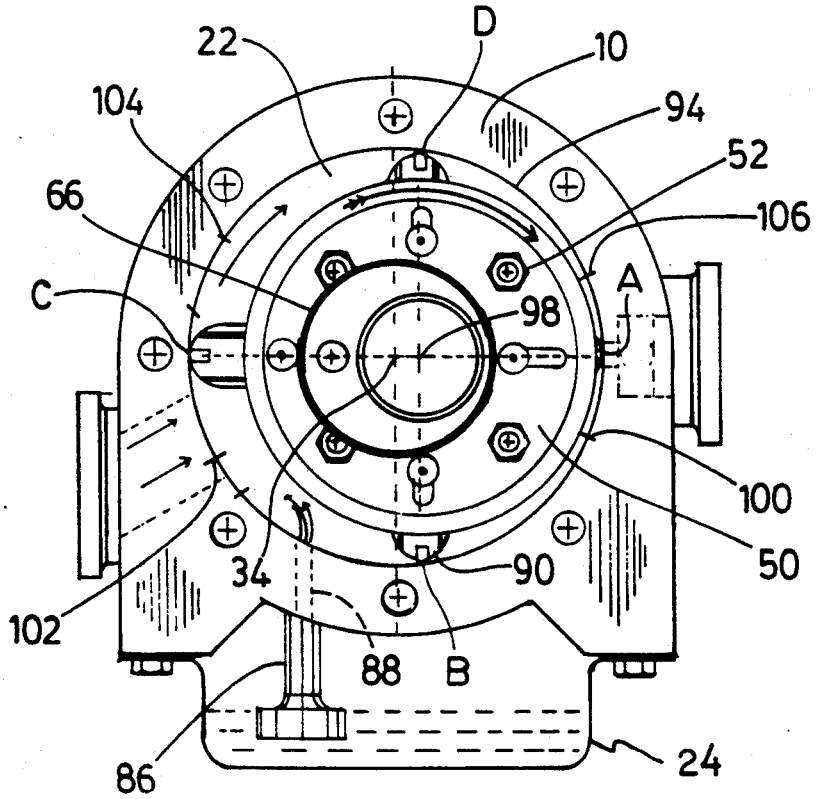
FIG. 4

FIG. 9A
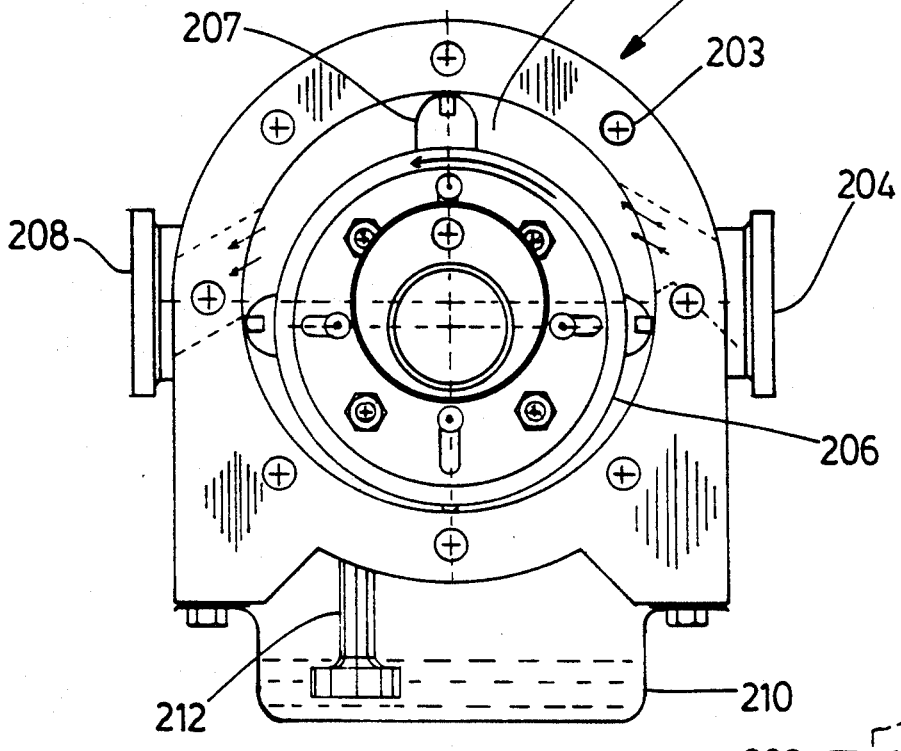
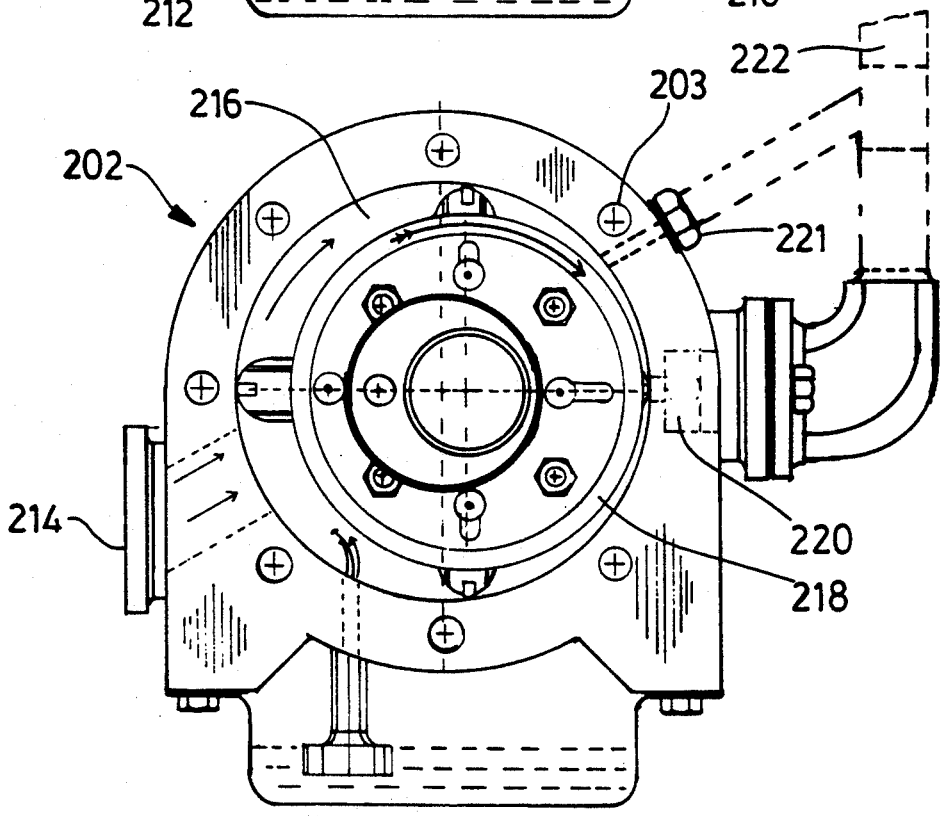
FIG. 9B

ROTARY FLUID APPARATUS HAVING PAIRS OF CONNECTED VANES

This invention relates to fluid pumps and fluid drives, including such systems employing hydraulic fluid, air and steam.

A wide variety of rotary engines and rotary pumps are known and have been used for a considerable number of years. For example, hydraulic pumps employing hydraulic oil as the pump fluid are in common use. One example of such use is in machinery where hydraulic fluid must be fed to operate hydraulic cylinders or jacks. Air compressors are also well known and are used for the purpose of providing compressed air to operate machinery and equipment such as air hammers or mining equipment.

Rotary combustion engines of various types including engines employing movable vanes have been proposed and used. The present applicant constructed a rotary combustion engine which is described and illustrated in applicant's Canadian Pat. Nos. 974,886 and 1,011,256. Difficulties were encountered with this engine because the materials required to obtain the necessary close tolerances were expensive and there was substantial build up of heat in the engine resulting in deformation of the housing.

An improved combustion engine has been developed by the present applicant and is disclosed and claimed in applicant's co-pending Canadian patent application Ser. No. 601,885 filed Jun. 6, 1989 and a corresponding U.S. application Ser. No. 438,725 filed Nov. 17, 1989. In this internal combustion engine the housing has a circular rotor chamber containing a circular rotor which is offset from the centre of the chamber. The rotor has at least two pairs of vanes mounted therein so as to be movable in the radial direction. A first member of each pair of vanes extends diametrically opposite to the second member and the members of each pair have a combined length substantially equal to the distance between a specific point on the circumferential chamber wall which is closest to the circumference of the rotor and a second point diametrically opposite thereto on the chamber wall. In order to permit free rotation of the rotor and vanes in the chamber, portions of the walls of the chamber are removed.

The present invention employs some of the concepts of the rotary internal combustion engine described and illustrated in the aforementioned application to provide an improved fluid drive or pump apparatus which can be manufactured at reasonable cost and which is reliable in use. A preferred embodiment of a pump constructed in accordance with the present invention is able to provide a large outflow of pumped fluid while at the same time being quite efficient in power usage. Also, pumps constructed in accordance with the present invention can be made in a variety of sizes including both very large and very small pumps. Compared to some known rotary pumps, a preferred embodiment of the pump disclosed herein is able to operate quietly. Although some types of pumps presently in use are suitable for high pressure uses, they suffer from high static noise and are limited in their size.

According to one aspect of the present invention, a fluid drive or pump apparatus comprises a housing defining a substantially circular rotor chamber therein, drive shaft means extending through this chamber, and a circular rotor in the chamber mounted on the drive shaft means to rotate therewith and having a diameter less than the diameter of the chamber. The rotor and drive shaft are offset from the centre axis of the chamber. At least one pair of vanes are mounted in the rotor and are slidable radially therein. One member of each pair is located diametrically opposite to the other member and is rigidly connected thereto. The members of each pair have a combined connected length substantially equal to the distance from a specific point in the circumferential wall of the chamber which is closest to the circumference of the rotor and a second point diametrically opposite thereto. There are a fluid inlet extending through the housing and opening into the chamber and a fluid outlet extending through the housing and in fluid communication with the chamber. A portion of each of two circumferential wall sections between said specific point and said second point is slightly removed to permit full rotation of the rotor and vanes in the chamber.

In the preferred embodiment, the vanes of each pair are connected together by connecting rods extending through the drive shaft and slidable therein. Also, cam followers are mounted on the sides of the vanes and two generally circular cams are mounted on the sides of the housing. The cam followers engage the circular cams and act to reduce the outward centrifugal force and friction caused by the vanes on the circumferential wall of the chamber at high rotational speeds.

According to another aspect of the invention, a fluid pump drive system for a transporting device such as a vehicle comprises a double fluid pump with first and second pump sections, each section having a substantially circular rotor chamber therein. A drive shaft mechanism extends through each rotor chamber and two circular rotors are mounted on this drive shaft mechanism to rotate therewith. Each rotor is mounted in a respective one of the rotor chambers and has a diameter less than the diameter of its respective chamber. The rotors and the drive shaft mechanism are offset from a central axis of the two rotor chambers. Vanes are slidably mounted in the rotor and fluid inlets and outlets are in fluid communication with the two rotor chambers. A suitable device selectively engages or disengages a portion of the drive shaft means connected to the rotor in the second pump section from the rest of the drive shaft whereby either the first pump section can be used alone while the second pump section is not operating or the two pump sections can be used together.

In a preferred embodiment of the aforementioned fluid pump drive system, the device for engaging or disengaging a portion of the drive shaft is a clutch mechanism. Preferably the fluid inlets for the two rotor chambers are connected together and the fluid outlets are also connected together.

According to a further aspect of the present invention, a steam engine comprises a housing defining a substantially circular rotor chamber therein, a drive shaft extending through this chamber and a circular rotor located in the chamber mounted on the drive shaft to rotate therewith. The rotor has a diameter less than that of the chamber. The rotor and drive shaft are offset from the centre axis of the chamber. At least three pairs of vanes are mounted in the rotor and are slidable radially therein. One member of each pair is located diametrically opposite to the other member and is rigidly connected thereto. The members of each pair have a combined connected length substantially equal to the distance from a specific point on the circumferential wall of the chamber which is closest to the circumference of the rotor and a second point on the wall of the chamber diametrically opposite thereto. A steam inlet extends through one side of the housing and opens into the chamber and a steam outlet extends through the other side of the housing and is in fluid communication with the chamber. A portion of each of two circumferential wall sections between the specific point and the second point is slightly removed to permit full rotation of the rotor and vanes.

Further features and advantages will become apparent from the following detailed description taken in conjunction with the accompanying drawings.

In the drawings,

FIG. 1 is a front elevation of a hydraulic pump or motor constructed in accordance with the invention;

FIG. 2 is a side elevation of the pump or motor of FIG. 1;

FIG. 3 is a side view of a motor constructed in accordance with the invention with a side plate removed to reveal the circular rotor and parts of the vanes therein;

FIG. 4 is a side elevation similar to FIG. 3 but illustrating a fluid pump constructed in accordance with the invention;

FIG. 9A is a side elevation of an air motor constructed in accordance with the invention, the motor again having a side plate removed to show the rotor and vanes;

FIG. 9B is a side elevation of an air compressor with its side plate removed;

Figure 5:
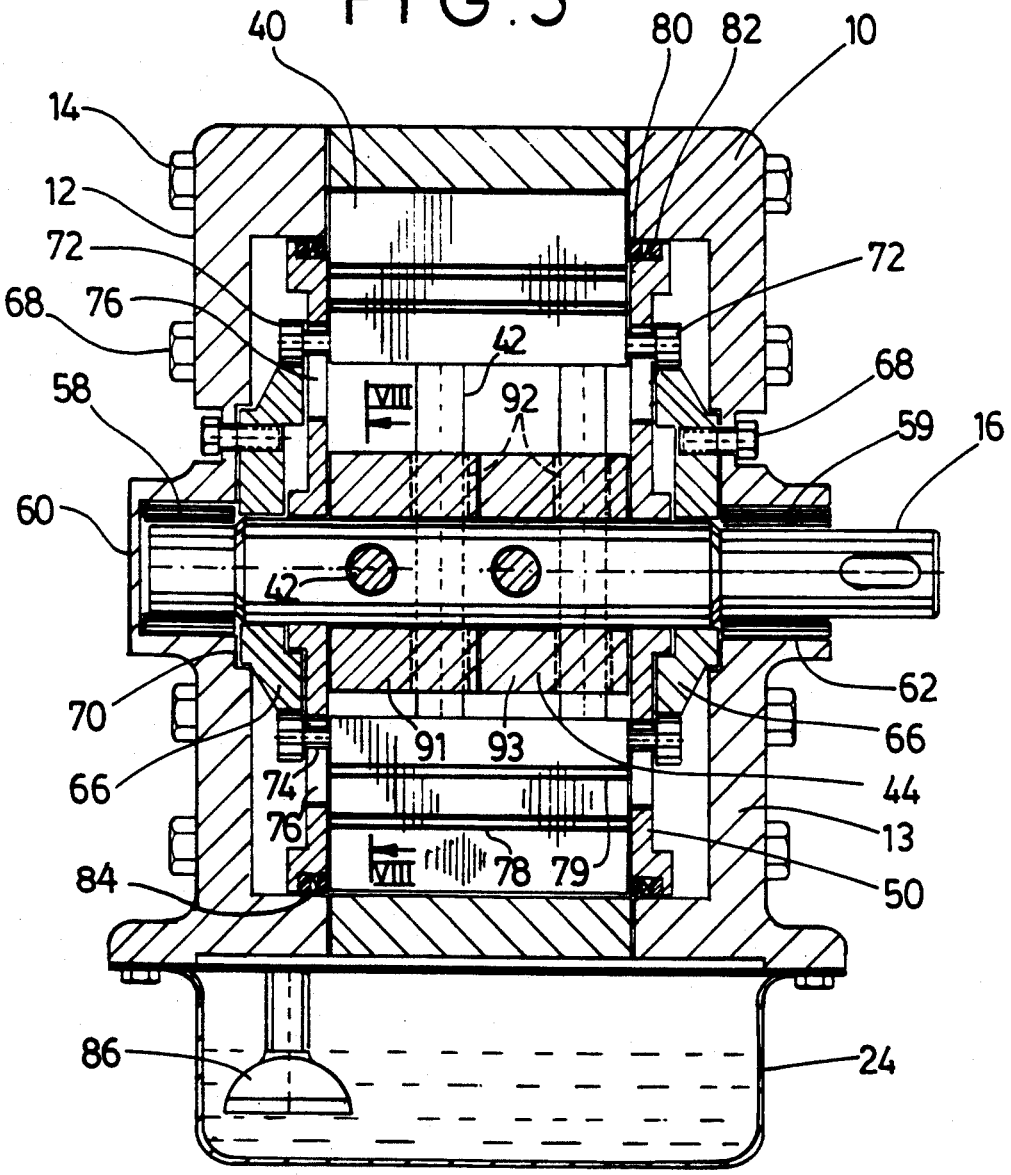
FIG. 5 is a cross-sectional view of a fluid pump or motor constructed in accordance with the invention, the view being taken along the vertical plane extending through the drive shaft.

In the rotary pump or motor of FIGS. 1 and 2 there is a metal housing 10 having detachable side coverings 12, 13 which are attached by means of bolts 14. Extending through a circular hole in the side of the housing is a drive shaft 16 which can be connected to the drive shaft of an engine if the illustrated device is operating as a pump. There are at least two ports 18 and 20, each of which can either be a fluid inlet or a fluid outlet extending through the housing and in fluid communication with a substantially circular rotor chamber 22 located in the housing. Also shown in FIGS. 1 and 2 is an oil pan 24 detachably connected to the bottom of the housing by means of bolts 26. It will be understood that this oil pan contains a supply of lubricating oil provided to lubricate the rotor and vanes of the device. Bolts 15 are used to attach a circular cover plate 17 which extends over the end of the shaft 16. The plate 17 contains suitable oil passageways to permit excess oil to return to the oil pan.

Turning now to the rotary drive motor illustrated in FIG. 3, with the side cover removed, there is shown a series of bolt holes 32 in the circular wall of the housing, which holes accommodate the aforementioned bolts 14. Rotatably mounted in the chamber 22 is a circular rotor 31 mounted on the drive shaft 16 to rotate therewith. The rotor and drive shaft are offset from the centre axis of the chamber indicated at 34. It will be noted that there is a specific point A on the circumferential wall of the chamber 22 which is closest to the circumference of the rotor 31. Two pairs of vanes 40 are mounted in the rotor 31 and are slidable radially in the rotor. Although the use of two pairs is illustrated, workable embodiments can be constructed according to the invention with only one pair of vanes or with more than two pairs. These vanes can be seen most clearly in FIG. 12 wherein the rotor and vanes are shown separately. In the embodiment of FIGS. 3 to 5, there are two pairs of vanes with one member of each pair being located diametrically opposite to the other member and rigidly connected thereto by means of metal connecting rods 42. These rods extend right through the drive shaft 16 which has a central section 44 having a diameter substantially larger than the remainder of the drive shaft. The rods 42 are preferably guided by two bearing rings 91 and 93 which are free to move axially on the shaft and which permit expansion and contraction of vanes which are rigidly connected to the rods. Mounted in holes 95 in these two rings are suitable bushings 92 to permit easy sliding movement of the rods.

Figure 12:
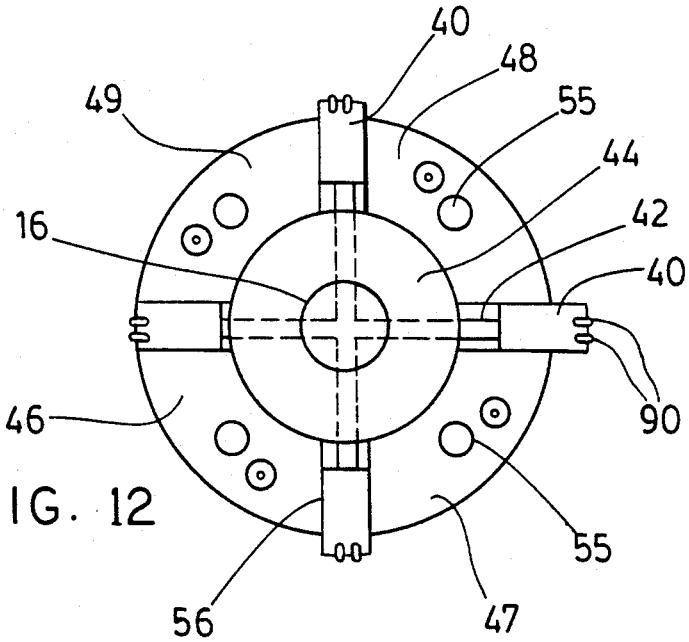
FIG. 12 is a detail side view of the circular rotor and four movable vanes mounted in the rotor.
Figure 13:
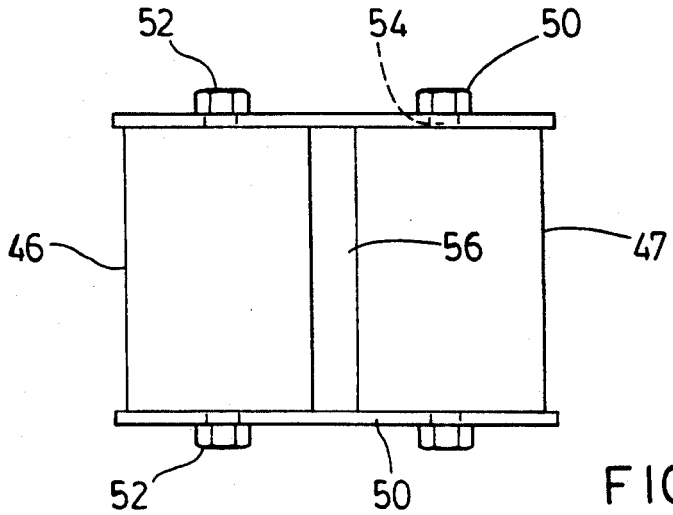
FIG. 13 is a detail side view of the circular rotor only.

The construction of the rotor member itself can be seen from an examination of FIGS. 12 and 13. The rotor member is divided into four sectors 46 to 49 which are rigidly connected together by two side covers 50 (one of which is removed in FIG. 6 to show the vanes). The covers 50 are connected by means of four bolts 52 to the sectors, these bolts extending through four evenly spaced holes 54 in each cover and threaded into the holes 55 in the rotor sectors. Extending between adjacent sectors are vane passageways 56, the inner ends of which are closed by the rings 91 and 93 on the shaft.

Figure 8A:
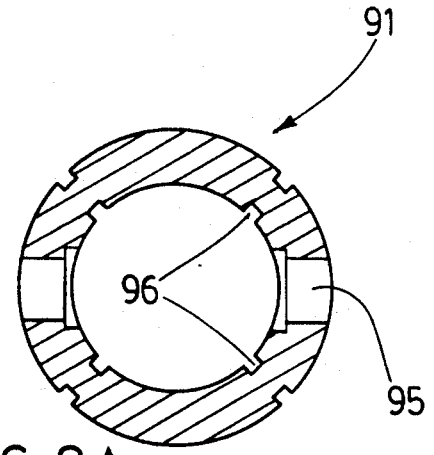
FIG. 8A is a cross-sectional view of a ring taken along the line VIII—VIII of FIG. 5.
Figure 8B:
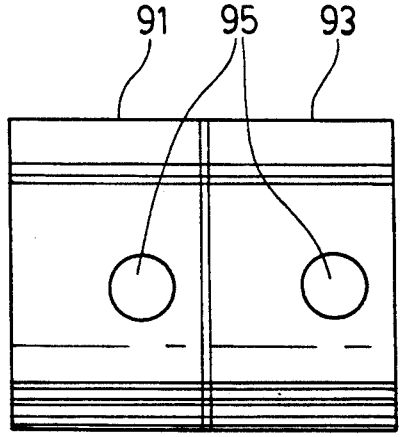
FIG. 8B is a side view of the two rings mounted on the shaft for the rotor.

Turning now to the features shown in FIG. 5 of the drawings, it will be seen that the drive shaft 16 is rotatably mounted in the sides of the housing by means of two sets of bearings 58 and 59. The bearing set 58 on the left hand side of FIG. 5 is mounted in a cup section 60. The side covering 13 on the opposite side of the housing has a central opening to permit the shaft 16 to pass therethrough and in this opening 62 the bearing 59 is mounted. In the preferred embodiment illustrated, the central section 44 of the drive shaft is formed by the two removable rings 91 and 93 which are of the same diameter and width. A key or keys (not shown) located in keyways 96 (see FIG. 8*a*) prevents these sleeves from rotating on the central shaft.

Two generally circular cams 66 are detachably mounted on the side covers 12 and 13 by means of bolts 68. By the term "generally circular" is meant that the cams are close to being circular about their perimeter but they are preferably contoured to match the contour of the rotor chamber which is not quite circular as explained hereinafter. Preferably the inside wall of each side covering is recessed at 70 to properly locate and secure each cam. Mounted on opposite sides of each vane 40 are cam followers in the form of rollers 72.

Each cam follower includes a shaft 74 that extends through a slot 76 in the side cover 50 of the rotor. One or more cam followers 72 engages the respective circular cam and acts to pass some of the outward centrifugal force on the vanes to the cams. Preferably the inner end of each shaft 74 is mounted in a bearing. In this way, the outward centrifugal force of the vanes on the circumferential wall of the chamber is reduced along with friction between the vanes and the wall and this is particularly advantageous at high rotational speeds. The effect is to prolong the useful life of the pump or fluid drive motor and reduce operational noise.

Also illustrated in FIG. 5 are various seals that can be used on the rotor and the vanes. Preferably located on the long side of each vane 40 are two oil seals 78 and 79 which engage the adjacent surface of the rotor sector. These are straight seals that extend the entire width of the vane. Extending about the circumference of each side cover 50 are two split ring seals 80 and 82 which engage the circumferential wall of the chamber. Between these two sealing rings is a wavy steel spring 84 which acts to push the seal 80 outwardly against the side of the vanes 40.

Also shown in FIG. 4 is the aforementioned oil pan 24 containing a supply of lubricating oil and extending into this oil pan is an oil inlet 86 through which oil is sucked into the chamber through passageway 88 located in the bottom of the housing. It will be appreciated that a suction force is created by the rotation of rotor and vanes in a clockwise direction in FIG. 4.

A further seal or seals 90 are located in the outer end of each vane 40 and these seals sweep along the circumferential wall of the rotor chamber. In the embodiments of FIGS. 3 and 4, one such seal 90 is shown while the vanes 40 shown in FIG. 12 have two spaced apart seals 90. These are straight metal seals secured in slots formed in the end of the vanes.

As can be seen from FIG. 5, the connecting rods 42 that connect one pair of vanes are offset in the axial direction from the connecting rods that connect the other pair of vanes. In this way the rods are able to pass by one another. It should further be noted that by connecting the vanes 40 in this manner using rigid steel rods, the vanes at all times maintain an orientation generally perpendicular to the inner walls of the chamber.

FIG. 4 illustrates how one calculates the dimensions of the rotor chamber and the rotor and vanes to keep the rotor vanes in constant contact with the chamber wall 94 and to permit free rotation of the rotor and vanes. If one draws a line from the centre 34 of the rotor chamber 22 straight towards the centre 98 of the rotor and continue on to the wall of the chamber, one arrives at a specific point A, the point where the rotor is closest to the circumferential wall of the chamber.

If one takes as an example a pump housing having a 15 inch diameter chamber with a 13 inch diameter rotor, the distance between the centre point 34 and the centre point 98 is 1 inch. The distance between point A and a point C diametrically opposite point A on the chamber wall is 15 inches and a pair of diametrically opposed vanes 40 having a total overall length of 15 inches will fit properly in this chamber. However, when the rotor turns such that the vanes measuring 15 inches are in a position between B and D it is found that the distance (prior to any modification of the circular rotor chamber) is too small by approximately 4 mm to allow the vanes to pass. This is due to the difference in circumference between the inner wall 94 of the housing and the outer circumference of the rotor and the fact that the rotor is offset. It has been found that with a 15 inch diameter interior housing and a 13 inch diameter rotor offset by 1 inch, it is necessary to increase the distance between B and D by approximately 4 mm more than it would be if the chamber was perfectly circular. This is done by machining the area between points 100 and 102, and points 104 and 106. The machining is gradual, reaching its greatest depth of 2 mm at points B and D. Point 106 is located 135 degrees approximately from point 104 and point 102 is located approximately 135 degrees from point 100. To provide another example, if one uses a 12 inch diameter chamber with a 10¼ inch diameter rotor, there would be an offset from the centre of the chamber to the centre of the rotor of ⅞ inch. The amount of machining required then at points B and D is that required to remove 1½ mm of material. In summary, using these sets of numbers as examples, one can readily calculate or compute the amount of machining necessary for any size of rotor, housing and offset.

Figure 6:
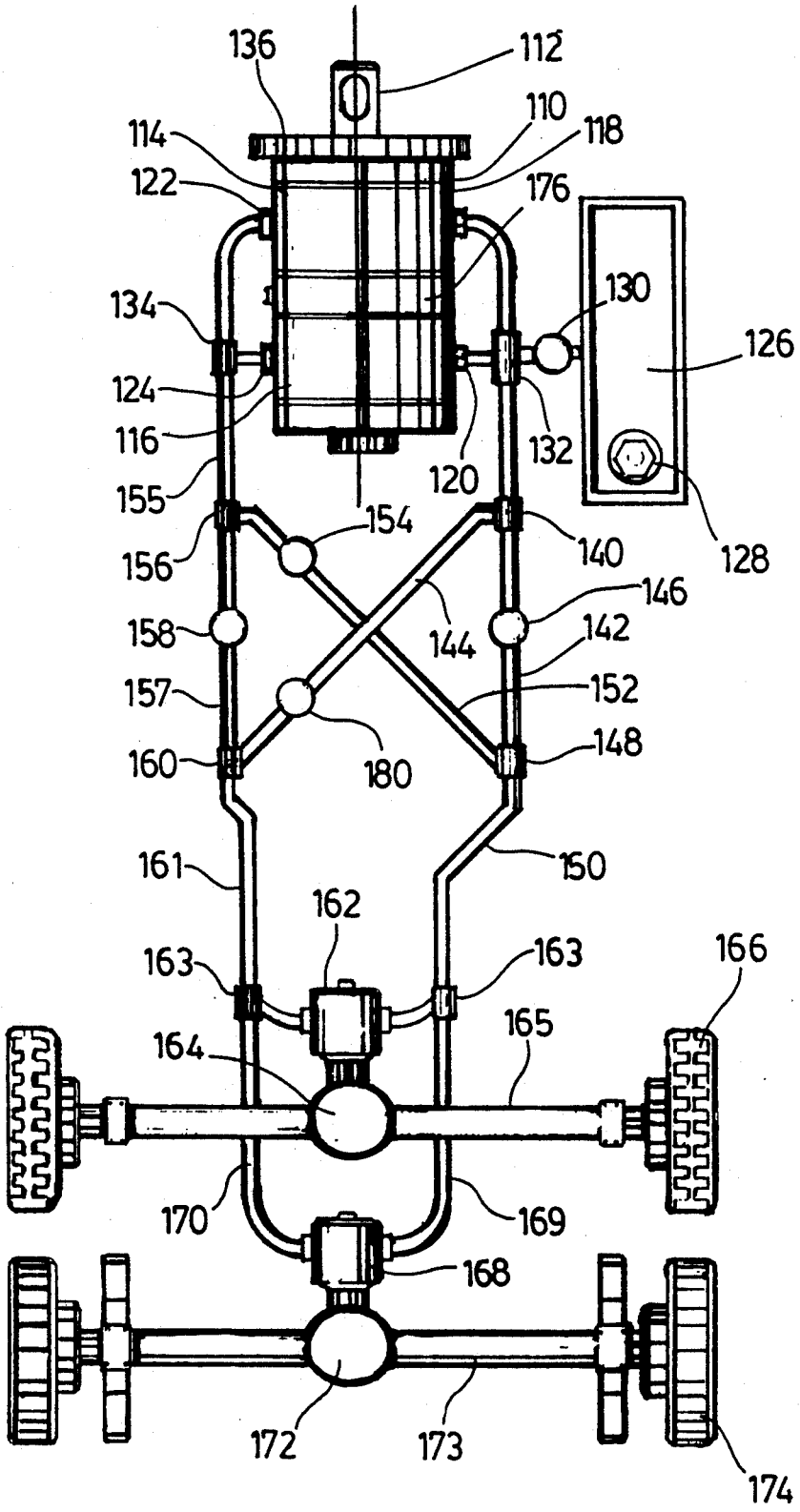
FIG. 6 is a schematic illustration of a pump drive for a vehicle constructed in accordance with the invention.

Turning now to the fluid pump drive system for a transporting device, such as a vehicle, illustrated in FIG. 6, this system includes a double fluid pump 110 which is driven by drive shaft means, a projecting end portion of which can be seen at 112. It will be understood that the end portion 112 would be connected to the output shaft of a power source, typically an internal combustion gasoline or diesel engine. The pump 112 has a first pump section 114 and a second pump section 116 which are rigidly connected together side-by-side. Each of these pump sections is constructed in the manner of the hydraulic pump described above and illustrated in FIGS. 4, 5, 12 and 13 of the drawings. Thus, each pump section has its own circular rotor mounted on the aforementioned drive shaft means to rotate therewith. Each of these rotors is mounted in a separate rotor chamber. The rotors and drive shaft means are offset from a centre axis of the two rotor chambers. Pairs of vanes are slidably mounted in the rotor. There are fluid inlets 118 and 120 for the respective rotor chambers and there are fluid outlets 122 and 124 for the rotor chambers. Hydraulic fluid is supplied to the system from a reservoir tank 126 having a filler cap 128. In the hydraulic oil line from the reservoir tank there is a control valve 130. The oil inlets 118 and 120 have hydraulic lines extending therefrom and these are connected together by line junction member 132. Similarly, the outlets from the two pump sections are connected together by hydraulic oil lines and junction connector 134. Preferably each oil outlet 122, 124 is fitted with a one-way valve of known construction to permit the flow of hydraulic oil only in the outwards direction. The double fluid pump can be connected to an engine or power source by means of connecting flange 136.

Hydraulic oil lines connect the double pump to one or two hydraulic motors used to drive the vehicle. In the illustrated embodiment oil line 138 extends rearwardly from the junction 132 to T-connector 140. Connected to this member are an oil line 142 and a cross-over line 144. Located partway along the line 142 is control valve 146 which can be solenoid operated. The line 142 connects to another T-connector 148 which in turn is connected to oil line 150 and cross-over line 152. Located partway along the line 152 is a reversing control valve 154, again a valve that can be remotely operated by a known solenoid mechanism. Extending rearwardly from the T-connector 134 is oil line 155 which is connected to the line 152 by T-connector 156. The connector 156 is also connected to oil line 157 in which is mounted a valve 158. The rear end of line 157 is connected to T-connector 160 which is also connected to cross-over line 144. Extending rearwardly from the connector 160 is another oil line 161. Both of oil lines 150 and 161 are connected to entry ports in a first hydraulic motor 162 by T-connectors 163.

The hydraulic motor 162 can be constructed in accordance with the invention or in accordance with known constructions for hydraulic motors. As illustrated, the motor has its drive shaft connected to a differential 164 which in turn is connected to a first vehicle axle 165 on which vehicle wheels 166 are mounted.

If the system is to have two driven axles, it can be provided with a second fluid drive motor 168 connected by hydraulic oil lines 169 and 170 to the T-connectors 163. The motor 168 is connected to a second differential 172 which in turn is connected to a second vehicle axle 173 that drives two rear wheels 174. This transmission system can be readily adapted to drive a vehicle with more than two axles if required.

With the fluid pump drive system of FIG. 6, it is possible to operate only the first pump section 114 or to operate both pump sections together. This capability is provided by means for selectively engaging or disengaging a portion of the drive shaft means connected to the rotor in the second pump section 116 from the rest of the drive shaft means. A straightforward means for accomplishing this engagement or disengagement is a clutch mechanism located at 176, that is in the central section of the double pump housing. The construction of clutch mechanisms of this type is well known and further description of this mechanism is deemed unnecessary herein. Instead of a clutch mechanism, one can employ a suitable gear mechanism, again, of known construction. Generally speaking, one would employ only the first pump section to commence movement of the vehicle and at low vehicle speeds but both pump sections would operate to achieve higher vehicle speeds. Forward drive is accomplished by closing valves 154 and 180 and opening valves 130, 146 and 158.

By suitably operating the various valves in the system, this hydraulic drive can be used not only to drive the vehicle along the ground but also to slow it down. Thus, if the valves 130, 154 and 180 are closed and the source of power is disengaged from the shaft 112 the power required to circulate the oil in the system will cause the vehicle to slow down. The equivalent of a neutral position for this transmission is achieved by opening the valves 130, 146 and 154 and closing the valves 158 and 180. If one wishes to drive the vehicle in reverse, the valves 146 and 158 are closed and the valves 154 and 180 are opened. The oil pumped out of the double fluid pump will then flow through lines 152 and 150 to the two fluid drive motors 162 and 168 which are reversible. Oil returning from the motors passes through line 161 and line 144 to return to the inlets of the double fluid pump.

There are a number of advantages to the fluid pump drive system as illustrated in FIG. 6. Use of this system will avoid the need for a standard vehicle transmission and clutch and it also eliminates the currently used drive line from the transmission to the driven axle. With this system, it is also possible to eliminate the use of one or more differentials 164, 172. This can be accomplished by using two hydraulic drive motors to drive the right and left sides of the vehicle axle separately.

As indicated above, to start the vehicle in motion, the driver uses only the first pump section 114 which preferably has a pumping capacity equal to about 60 per cent of the capacity of the motor or motors used to drive the vehicle axles. The first section continues to be used by itself at low operational speeds but as the speed is increased to a certain selected level, the second pump section 116 is activated. The second section 116 preferably has a pumping capacity equal to that of the first section so that the capacity of the two sections is about 120% of the capacity of the driven motor or motors. This permits the motors to operate in an overdrive speed range if desired.

In the case of large multiaxle vehicles having two or more driven axles, use of the above described hydraulic transmission system can reduce the weight of the vehicle significantly. It is estimated that a weight saving of as much as one ton can be obtained by avoiding the need for numerous large gear mechanisms. Another advantage of the present system in vehicles of this type is that it will permit the use of two smaller engines rather than a large single engine as the main source of power. This arises from the fact that the first pump section can be operated by a single small engine when only this pump section is required to operate.

The fluid pump drive system of FIG. 6 can be used in earth moving vehicles, army vehicles, and similar units requiring one or more driving axles. This drive or transmission system is also adaptable to drive other types of transporting devices. For example, it can be used to drive a boat or ship or even the propeller of an airplane. In summary, the described double fluid pump system can be used for a wide variety of purposes to provide a reliable rotary drive system.

Figure 7:
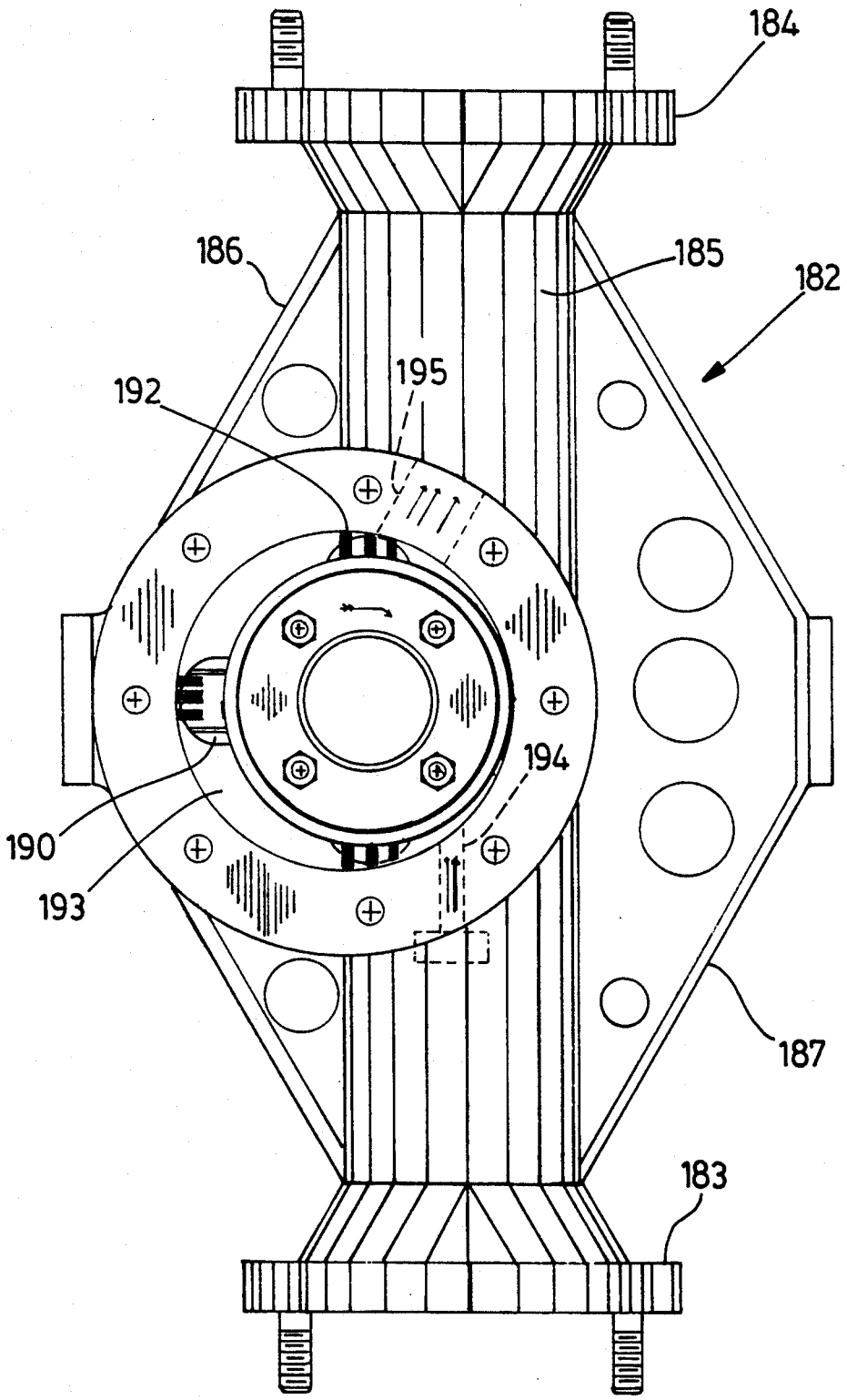
FIG. 7 is a side elevation of an oil pump with a side plate removed to show the rotor.

A pump apparatus suitable for pumping crude oil from an oil well is illustrated in FIG. 7. It will be understood that this pump apparatus is constructed in the same manner as the pump apparatus described above which is illustrated in FIGS. 4, 5, 12 and 13, except as described hereinafter. The apparatus 182 is designed to turn slowly, which is necessary in a pump of this type because of the heaviness and viscosity of the oil. Typically, the rotational speed of the rotor does not exceed 50 to 100 RPM. The apparatus 182 includes a base with connecting flange 183 and a top with a connecting flange 184. Extending between the base and the top is a tubular pipe section 185 which may be strengthened by brace members 186 and 187 to help support the rotary pump. It will be appreciated that one side of the pump has been removed so that the rotor 188 can be viewed. Mounted in the rotor are the two pairs of sliding vanes 190 which are provided with three apex seals 192. The rotor is driven by a drive shaft (not shown) so as to draw crude oil into chamber 193 through oil inlet 194. The heavy crude oil passes through an outlet 195 that exists near the top of the chamber 193. This pump is excellent for use at sea because it is able to withstand the corrosive conditions of this environment.

FIGS. 9*a* and 9*b* of the drawings illustrate a fluid motor 200 which uses air as the fluid and an air compressor 202. It will be understood that the air motor and the air compressor are constructed substantially in the same manner as the above described hydraulic motor and hydraulic pump except for differences explained hereinafter. In both FIGS. 9*a* and 9*b*, a side cover or plate on the housing has been removed to show the rotor and vanes. This side cover is attached by bolts that are threaded into the bolt holes 203. In the air motor of FIG. 9a, air under pressure enters through air inlet 204 passing into the rotor chamber 205. The air causes the circular rotor 206 to rotate as it pushes on the vanes 207. The air exits from the motor through outlet 208. The motor is lubricated by a lubricating oil contained in the pan 210. The oil is drawn into the chamber through oil inlet 212.

Turning now to the air compressor of FIG. 9b, in this unit low pressure air enters through inlet 214 and flows into the circular chamber 216 where it is compressed by circular rotor 218. In this air compressor there are two air outlets located at 220 and 221. The compressed air passes through both of these outlets at all times and only in the outflowing direction (which can be ensured by the provision of suitable one way valves). Air lines from the two outlets 220 and 221 can connect together at 222 if desired. It will be understood that with an air compressor unit of this type, the pump or compressor usually continues to operate until a maximum desired air pressure is achieved in the system. For this reason, it is not necessary to build up a high air pressure necessarily in the chamber 216 of the compressor. The provision of the two outlets 220 and 221 avoids the unnecessary build up of heat in the compressor itself. Generally speaking, the compressor system is provided with an automatic shut off when the maximum required air pressure is achieved in the airline or tank.

Figure 10:
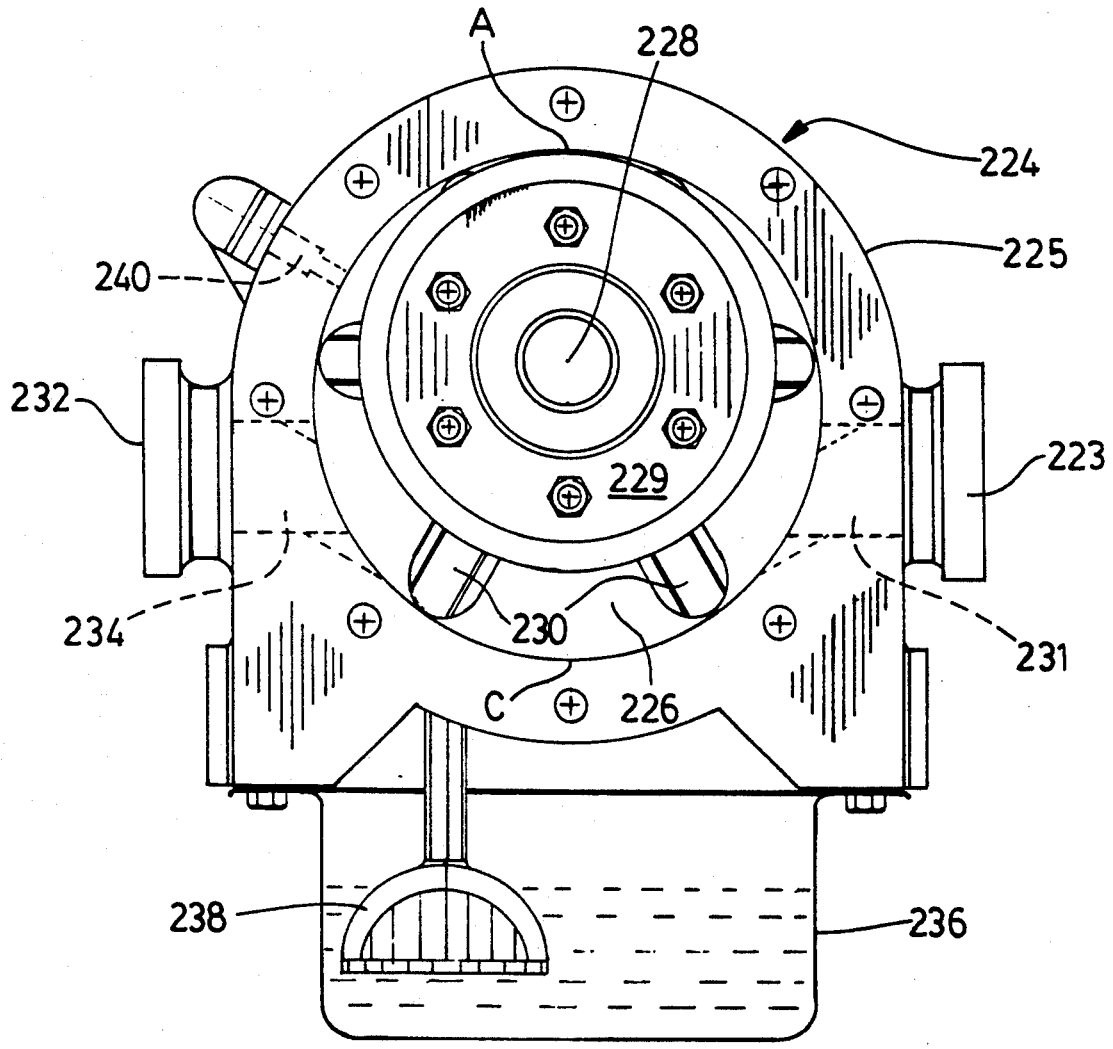
FIG. 10 is a side elevation of a steam engine constructed in accordance with the invention, the engine having one side plate removed in order to show the rotor and vanes.

Turning now to the steam operated system shown in FIG. 10 of the drawings, this steam turbine 224 is constructed substantially in the same manner as the hydraulic pump described above, except as explained hereinafter and, generally speaking, the steam turbine is larger in size than a hydraulic pump. The turbine has a housing 225, with a side plate that has been removed so that the rotor and vanes in rotor chamber 226 can be seen. The rotor rotates a drive shaft located at 228 that extends through the chamber and out one side thereof. A circular rotor 229 is mounted on the drive shaft and rotates therewith. The rotor and drive shaft are offset from the centre axis of the chamber.

In the illustrated steam turbine, there are three pairs of vanes 230 mounted in the rotor and slidable radially therein. The increased number of vanes is desirable or required due to the increased size of the steam turbine compared to the smaller hydraulic units. Again, one member of each pair is located diametrically opposite to the other member and is rigidly connected thereto. The members of each pair have a combined length substantially equal to the distance from a specific point A on the circumferential wall of the chamber which is closest to the circumference of the rotor and a second point C located diametrically opposite the point A. Steam inlet means are provided at 223, the inlet means including a short passageway 231 that extends through the housing and opens into the chamber 226. There are also steam outlet means 232 including a short passageway 234 extending through the housing and in fluid communication with the chamber. Lubricating oil for the steam engine is provided from oil pan 236. The oil in the pan is used to lubricate the bearings (not shown) that support the rotor in the sides of the housing. The oil enters through oil inlet 238. Further lubricating oil is provided when required through optional oil duct 240 which opens into the circumferential wall of the chamber 226. The lubricating oil passing through this duct is used to lubricate the apex seals, if any, located in the outer ends of the vanes. However, in the very large steam turbine illustrated in FIG. 10, no apex seals are provided in the ends of the vanes. In large steam turbines which rotate at high speed, apex seals at the ends of the vanes can wear out quickly. Moreover, such seals should not be required in such steam turbines because the high pressure of the steam helps to support the heavy rotor and helps to prevent the vanes from pressing too hard on the circumferential wall of the chamber. In the case of small steam turbines, for example, those generating less than 1,000 horsepower, apex seals can be provided at the ends of the vanes. A rotary steam turbine constructed in accordance with the invention can be used to power a railway engine or a boat or ship. The number of pairs of vanes in steam turbines constructed in accordance with the invention can vary depending upon the particular requirements for the turbine. Generally speaking, by increasing the number of vanes, there is an increase in the speed of rotation and in the efficiency of the unit. An advantage of applicant's steam turbine is that it saves energy by its increased efficiency compared to other rotary engines.

Figure 11:
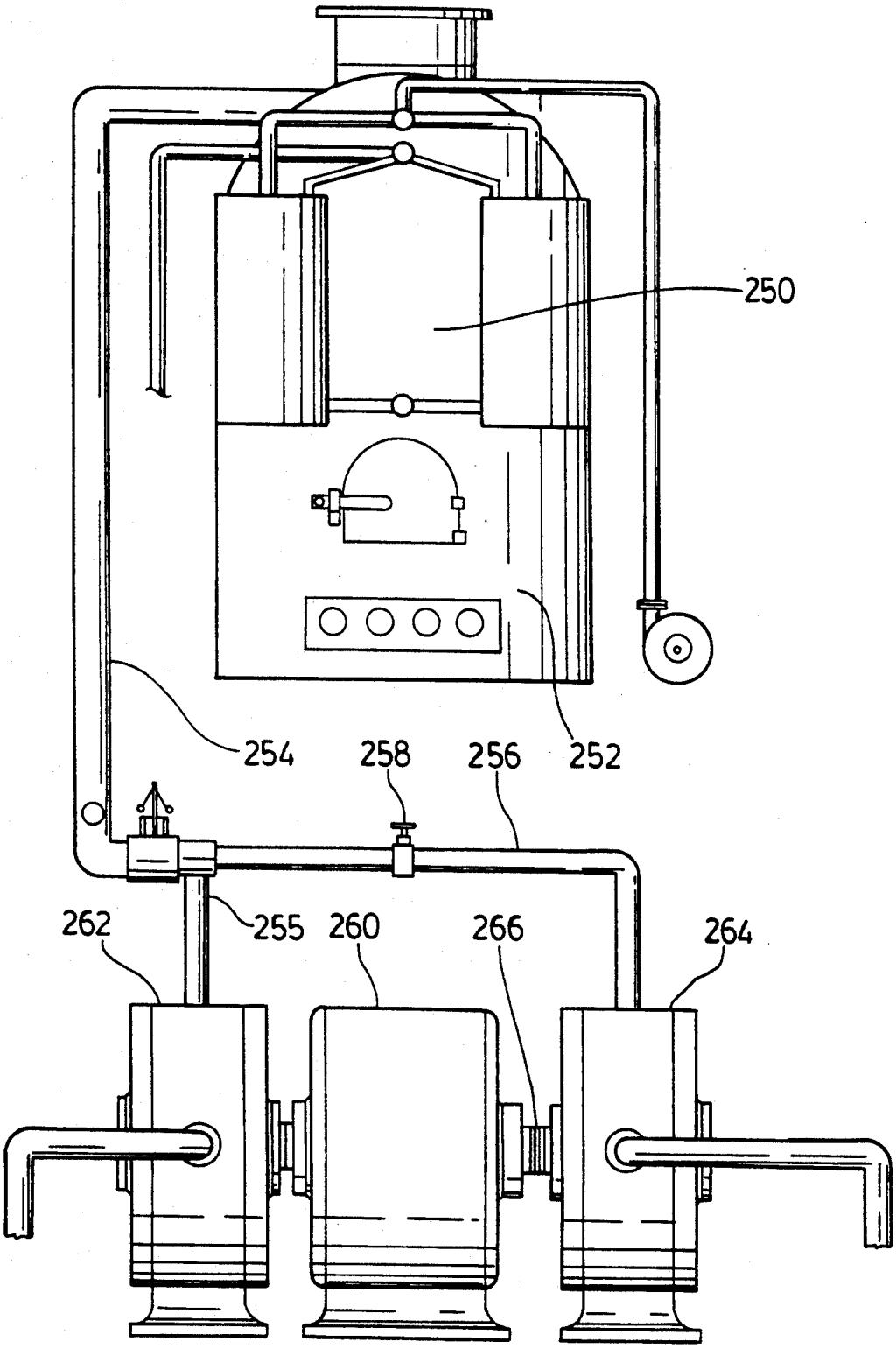
FIG. 11 is a schematic illustration of a steam driven system employing two of the steam engines of FIG. 10.

Turning now to the steam power system illustrated in FIG. 11, there is provided a standard steam generating boiler 250 having a heating unit located in the bottom 252 thereof. The steam generated by the boiler passes through steam line 254 which divides into branch lines 255 and 256. A manually operated control valve can be provided at 258 in order to control the passage of steam through line 256. Mounted on either side of an electrical generator 260 are steam turbines 262 and 264 constructed in accordance with the invention. It will be understood that these steam turbines can be constructed in the same fashion as the steam turbine illustrated in FIG. 12. The generator 260 can be driven by both of the steam turbines or by only one depending on power requirements. A suitable clutch unit is provided at 266 to permit disengagement of the drive shaft of the turbine 264 from the generator. This clutch mechanism can be of any suitable known construction. If there is only a low power consumption, the turbine 264 is disconnected and the generator is rotated by the turbine 262 operating alone.

Although the illustrated versions of applicant's invention all have the rotor positioned so that a point on its periphery is in close contact with the wall of the chamber, this is not an essential requirement for this rotor. In fact, the rotor can be spaced ¼ inch or more (at its closest point) from the rotor chamber wall. The vanes in the rotor must however engage the chamber wall as they are rotated.

It will be appreciated by those skilled in this art that various modifications and changes can be made to the described fluid drive motors and fluid pumps without departing from the spirit and scope of this invention. Accordingly, all such modifications and changes as fall within the scope of the appended claims are intended to be part of this invention.

What is claimed is:

1. A fluid drive or pump apparatus comprising:

a housing defining a substantially circular rotor chamber therein, drive shaft means extending through said chamber, a circular rotor in said chamber mounted on said drive shaft means to rotate therewith and having a diameter less than the diameter of said chamber, said rotor and drive shaft means being offset from the centre axis of said chamber, at least one pair of vanes mounted in said rotor and slidable radially in said rotor, one member of each pair being located diametrically opposite to the other member and rigidly connected thereto, the members of each pair having a combined connected length substantially equal to the distance from a specific point on the circumferential wall of the chamber which is closest to the circumference of the rotor and a second point on the wall of said chamber diametrically opposite said specific point, fluid inlet means extending through said housing and opening into said chamber, fluid outlet means extending through said housing and in fluid communication with said chamber, a portion of each of two circumferential wall sections between said specific point and said second point being slightly removed to permit full rotation of said rotor and vanes in said chamber, and cam followers mounted on sides of said vanes and generally circular cam means mounted on a side of the housing, said cam followers and cam means acting to reduce the outward force of said vanes on the circumferential wall of said chamber, said cam means being contoured to match the contour of said circumferential wall of said rotor chamber.

2. An apparatus according to claim 1 wherein said apparatus is a hydraulic motor, there are at least two pairs of vanes mounted in said rotor, said fluid inlet means opens into said chamber at a point on the circumferential wall located more than 90 degrees around the centre axis of the chamber from said specific point and on one side of the motor, and said fluid outlet has an entry port in said circumferential wall located about 90 degrees around said centre axis from said specific point on the opposite side of the motor.

3. An apparatus according to claim 1 wherein said apparatus is a hydraulic pump, there are at least two pairs of vanes mounted in said rotor, said fluid inlet means opens into said chamber at a point on the circumferential wall located substantially more than 90 degrees but less than 180 degrees around the centre axis of said chamber from said specific point, and said fluid outlet means has an entry port in said circumferential wall located close to or at said specific point.

4. An apparatus according to claim 1 wherein said cam followers comprise two cam following rollers mounted on opposite sides of each vane and said cam means comprise two generally circular cam means mounted on opposite sides of said housing and each engaged by one or more of said rollers.

5. An apparatus according to claim 1 wherein there are at least two pairs of vanes mounted in said rotor and an outer tip section of each vane has sealing means mounted therein.

6. An apparatus according to claim 1 wherein the vanes of each pair are connected together by connecting rods extending through said drive shaft means and slidable therein; said connecting rods are guided by two split bearing rings which permit expansion and contraction of the vanes connected to the rods.

7. A fluid pump drive system capable of providing rotary drive comprising a double fluid pump with first and second pump sections, each section having a housing with a substantially circular rotor chamber therein with the rotor chamber having a circumferential wall, drive shaft means extending through each rotor chamber, two circular rotors mounted on said drive shaft means to rotate therewith, each rotor being mounted in a respective one of the rotor chambers and having a diameter less than the diameter of its respective chamber, the rotors and drive shaft means being offset from a centre axis of the two rotor chambers, portions of the circumferential wall of each rotor chamber being slightly removed to permit full rotation of the respective rotor and vanes in the chamber, at least two pair of vanes slidably mounted in said rotor for radial movement, one member of each pair being located diametrically opposite to the other member and rigidly connected thereto, the members of each pair having a combined connected length substantially equal to the distance from a specific point on the circumferential wall of the chamber which is closest to the circumference of the rotor and a second point on the circumferential wall of the respective chamber diametrically opposite said specific point, fluid inlet and outlet means in fluid communication with each rotor chamber, cam followers mounted on sides of said vanes and generally circular cam means mounted on a side of each housing, said cam followers and cam means acting to reduce the outward force of said vanes on the circumferential wall of said chamber, said cam means being contoured to match the contour of said circumferential wall of the respective rotor chamber, and a clutch mechanism for selectively engaging or disengaging a portion of said drive shaft means connected to the rotor in the second pump section from the rest of said drive shaft means whereby either said first pump section can be used alone while the second pump section is not operating or the two pump sections can be used together.

8. A drive system according to claim 7 wherein the fluid inlet means for the two rotor chambers are connected together and the fluid outlet means for the rotor chambers are connected together.

9. A drive system according to claim 7 including at least one hydraulic motor and hydraulic lines connecting said fluid inlet and outlet means to two hydraulic fluid ports of said at least one motor, said motor being operable in either of two rotary directions, and valve means in said hydraulic lines enabling the flow of hydraulic fluid through said at least one motor to be reversed.

10. A drive system according to claim 9 wherein there are two hydraulic motors and both are connected by said hydraulic lines to said fluid inlet and outlet means and wherein each motor is connected to an axle of a vehicle in order to rotate same.

11. An air drive or compressor apparatus comprising:

a housing defining a substantially circular rotor chamber therein with the rotor chamber having a circumferential wall, drive shaft means extending through said chamber, a circular rotor in said chamber mounted on said drive shaft means to rotate therewith and having a diameter less than the diameter of said chamber, said rotor and drive shaft means being offset from the centre axis of said chamber, at least one pair of vanes mounted in said rotor and slidable radially in said rotor, one member of each pair being located diametrically opposite to the other member and rigidly connected thereto, the members of each pair having a combined connected length substantially equal to the distance from a specific point on the circumferential wall of the chamber which is closest to the circumference of the rotor and a second point on the wall of said chamber diametrically opposite said specific point, a portion of each of two circumferential wall sections between said specific point and said second point being slightly removed to permit full rotation of said rotor and vanes in said chamber, cam followers mounted on sides of said vanes and generally circular cam means mounted on a side of the housing, said cam followers and cam means acting to reduce the outward force of said vanes on the circumferential wall of said chamber, said cam means being contoured to match the contour of said circumferential wall of said rotor chamber, air inlet means extending through said housing and opening into said chamber, air outlet means extending through said housing and in air flow communication with said chamber, and means for lubricating said rotor and vanes as they rotate.

12. An air drive or compressor apparatus according to claim 11 wherein a portion of each of two circumferential wall sections between said specific point and said second point is slightly removed to permit full rotation of said rotor and vanes in said chamber.

13. An air drive or compressor apparatus according to claim 12 wherein said lubricating means includes an oil supply below said housing and an oil passageway extending from said oil supply and through the bottom of said housing, said oil passageway opening into said chamber.

14. An air drive motor according to claim 11 wherein there are at least two pairs of vanes mounted in said rotor, said air inlet means opens into said chamber at a point on the circumferential wall located more than 90 degrees around the centre axis of the chamber from said specific point and on one side of the motor, and said air outlet has an entry port in said circumferential wall located about 90 degrees around said centre axis from said specific point on the opposite side of the motor.

15. An air compressor according to claim 11 wherein there are at least two pairs of vanes mounted in said rotor, said air inlet means opens into said chamber at a point on the circumferential wall located substantially more than 90 degrees but less than 180 degrees around the centre axis of said chamber from said specific point, and said air outlet means has an entry port in said circumferential wall located close to or at said specific point.

16. An air compressor according to claim 15 wherein said air outlet means includes a second entry port in said circumferential wall located a short distance from said specific point in the direction opposite to the direction of rotation of said rotor.

* * * * *